US011884371B2

(12) United States Patent
Ueno

(10) Patent No.: US 11,884,371 B2
(45) Date of Patent: Jan. 30, 2024

(54) DEVICE, METHOD, AND PROGRAM FOR CONTROLLING SHIP BODY

(71) Applicant: FURUNO ELECTRIC CO., LTD., Nishinomiya (JP)

(72) Inventor: Hideki Ueno, Takarazuka (JP)

(73) Assignee: FURUNO ELECTRIC COMPANY LIMITED, Nishinomiya (JP)

( * ) Notice: Subject to any disclaimer, the term of this patent is extended or adjusted under 35 U.S.C. 154(b) by 743 days.

(21) Appl. No.: 16/909,994

(22) Filed: Jun. 23, 2020

(65) Prior Publication Data

US 2021/0001964 A1 Jan. 7, 2021

(30) Foreign Application Priority Data

Jul. 5, 2019 (JP) ..... 2019-125657

(51) Int. Cl.
*B63B 79/40* (2020.01)
*B63B 79/10* (2020.01)

(52) U.S. Cl.
CPC ..... *B63B 79/40* (2020.01); *B63B 79/10* (2020.01)

(58) Field of Classification Search
CPC ..... B63B 79/40; B63B 79/10
USPC ..... 701/21
See application file for complete search history.

(56) References Cited

U.S. PATENT DOCUMENTS 5,268,844 A 12/1993 Carver et al.
6,884,128 B2 4/2005 Okuyama et al.
8,340,847 B2 12/2012 Sako et al.
8,943,988 B1 2/2015 Guglielmo et al.
9,377,780 B1 6/2016 Arbuckle et al.
9,718,527 B2 8/2017 Ito
9,950,777 B2 4/2018 Kishimoto et al.
(Continued)

FOREIGN PATENT DOCUMENTS

CN 109116838 A 1/2019
EP 2 246 765 A1 11/2010
(Continued)

OTHER PUBLICATIONS

Das et al., "Diesel Engine Control and Protection Monitoring using PID Controller", 2019 Innovations in Power and Advanced Computing Technologies (i-PACT), Mar. 22-23, 2019, pp. 1-6, IEEE.
(Continued)

*Primary Examiner* — Peter D Nolan
*Assistant Examiner* — Luke Huynh
(74) *Attorney, Agent, or Firm* — Studebaker & Brackett PC

(57) ABSTRACT

A ship body control device is provided, which includes a rudder controller configured to control a rudder angle of a ship, a sensor configured to measure a ship body direction of the ship, and an autopilot controller configured to output a rudder angle command to the rudder controller. The autopilot controller includes an angle-of-deviation calculating module configured to calculate a deviation angle of a stern direction from a target stern direction based on the ship body direction, and a rudder angle command setting module configured to set the rudder angle command so as to maintain a current rudder angle when the deviation angle is less than a first threshold, and to change it to a given fixed turning rudder angle when the deviation angle is the first threshold or more.

17 Claims, 7 Drawing Sheets

(56) References Cited

U.S. PATENT DOCUMENTS

| | | | | |
|---|---|---|---|---|
| 10,167,798 | B1 | 1/2019 | Van Camp et al. | |
| 10,723,431 | B1 | 7/2020 | Przybyl et al. | |
| 11,188,080 | B2 * | 11/2021 | Akuzawa | B63H 25/04 |
| 2004/0181322 | A1 | 9/2004 | Okuyama | |
| 2004/0242091 | A1 | 12/2004 | Okuyama et al. | |
| 2007/0134092 | A1 | 6/2007 | Rosenkranz et al. | |
| 2007/0293103 | A1 | 12/2007 | Kinoshita et al. | |
| 2009/0105962 | A1 | 4/2009 | Woolf et al. | |
| 2009/0288585 | A1 | 11/2009 | Mitsui et al. | |
| 2010/0121505 | A1 | 5/2010 | Yamazaki et al. | |
| 2012/0010766 | A1 | 1/2012 | Sako et al. | |
| 2015/0089427 | A1 | 3/2015 | Akuzawa | |
| 2016/0229511 | A1 | 8/2016 | Kishimoto et al. | |
| 2016/0280351 | A1 | 9/2016 | Ito | |
| 2017/0137103 | A1 | 5/2017 | Ito | |
| 2017/0277189 | A1 * | 9/2017 | Johnson | B63H 25/06 |
| 2017/0285645 | A1 | 10/2017 | Nakagawa | |
| 2017/0349258 | A1 * | 12/2017 | Kishimoto | B63B 79/15 |
| 2017/0365175 | A1 | 12/2017 | Harnett | |
| 2018/0015994 | A1 | 1/2018 | Kishimoto et al. | |
| 2018/0334234 | A1 | 11/2018 | Namba et al. | |
| 2019/0039708 | A1 | 2/2019 | Hayes et al. | |
| 2019/0084662 | A1 * | 3/2019 | Wong | G05D 1/0208 |
| 2019/0249906 | A1 | 8/2019 | Wu et al. | |
| 2019/0263483 | A1 | 8/2019 | Li et al. | |
| 2020/0407034 | A1 | 12/2020 | Ueno | |
| 2021/0078690 | A1 | 3/2021 | Ueno | |

FOREIGN PATENT DOCUMENTS

| | | | |
|---|---|---|---|
| EP | 3173324 | A1 | 5/2017 |
| EP | 3 214 523 | A1 | 9/2017 |
| JP | S58-099198 | U | 7/1983 |
| JP | H08-198185 | A | 8/1996 |
| JP | H10-109693 | A | 4/1998 |
| JP | 2004-034805 | A | 2/2004 |
| JP | 2004-142537 | A | 5/2004 |
| JP | 2004-142538 | A | 5/2004 |
| JP | 2007-022422 | A | 2/2007 |
| JP | 2008-155764 | A | 7/2008 |
| JP | 2009-025860 | A | 2/2009 |
| JP | 2011-235839 | A | 11/2011 |
| JP | 2013-151241 | A | 8/2013 |
| JP | 2014-024421 | A | 2/2014 |
| JP | 2015-066979 | A | 4/2015 |
| JP | 2016-144971 | A | 8/2016 |
| JP | 2017-088111 | A | 5/2017 |
| JP | 2017-178242 | A | 10/2017 |
| JP | 2018-192976 | A | 12/2018 |
| JP | 6513677 | B2 | 5/2019 |
| KR | 10-2014-0080106 | A | 6/2014 |
| KR | 10-2018-0044087 | A | 5/2018 |
| WO | 2016/104030 | A1 | 6/2016 |
| WO | 2016/104031 | A1 | 6/2016 |
| WO | 2016/109832 | A2 | 7/2016 |
| WO | 2018/100748 | A1 | 6/2018 |
| WO | 2018/228670 | A1 | 12/2018 |

OTHER PUBLICATIONS

Petratos et al., "A novel robust MPC based aircraft auto-throttle for performing 4D contract flights", 2013 9th Asian Control Conference (ASCC), Jun. 23-26, 2013, pp. 1-6, IEEE.

Schöley et al., "Application of a modified error governor to electronic throttle control", 2017 22nd International Conference on Methods and Models in Automation and Robotics (MMAR), Aug. 28-31, 2017, pp. 815-819, IEEE.

Lee et al., "Assessment of Energy Savings With Variable Speed Drives in Ship's Cooling Pumps", IEEE Transactions on Energy Conversion, vol. 30, No. 4, Jun. 1, 2015, pp. 1288-1298, IEEE.

Haifeng et al., "The Speed Control of Marine Main Engine", 2014 Sixth International Conference on Measuring Technology and Mechatronics Automation, Jan. 10-11, 2014, pp. 770-773, IEEE.

Jiang et al., "An Integrated Control Simulation System of Ship Motion and Main Propulsion", 2014 IEEE International Conference on Information and Automation (ICIA), Jul. 28-30, 2014, pp. 865-869, IEEE.

Oh et al., "System Identification of a Model Ship Using a Mechatronic System", IEEE/ASME Transactions on Mechatronics, vol. 15, No. 2, Jun. 16, 2009, pp. 316-320, IEEE.

Micheau et al., "Engine speed limiter for watercrafts", IEEE Transactions on Control Systems Technology, vol. 14, No. 3, Apr. 24, 2006, pp. 579-585, IEEE.

An Office Action mailed by the United States Patent and Trademark Office dated Oct. 17, 2022, which corresponds to U.S. Appl. No. 17/015,801, and is related to the present application.

The extended European search report issued by the European Patent Office dated Feb. 26, 2021, which corresponds to European Patent Application No. 20195840.2-1015 and is related to U.S. Appl. No. 16/909,994.

Communication pursuant to Article 94(3) EPC issued by the European Patent Office dated Dec. 23, 2021, which corresponds to European Patent Application No. 20 195 841.0-1202 and is related to U.S. Appl. No. 16/909,994.

An Office Action mailed by the United States Patent and Trademark Office dated Mar. 16, 2023, which corresponds to U.S. Appl. No. 16/909,978, and is related to the present application.

An Office Action mailed by the United States Patent and Trademark Office dated Jan. 31, 2023, which corresponds to U.S. Appl. No. 17/015,801, and is related to the present application.

An Office Action mailed by the United States Patent and Trademark Office dated Mar. 3, 2023, which corresponds to U.S. Appl. No. 17/018,521, and is related to the present application.

The extended European search report issued by the European Patent Office dated Nov. 30, 2020, which corresponds to European Patent Application No. 20181370.6-1015 and is related to U.S. Appl. No. 16/909,994.

The extended European search report issued by the European Patent Office dated Dec. 10, 2020, which corresponds to European Patent Application No. 20182258.2-1015 and is related to U.S. Appl. No. 16/909,994.

An Office Action mailed by the United States Patent and Trademark Office dated Jan. 17, 2023, which corresponds to U.S. Appl. No. 16/909,906 and is related to the present application.

The extended European search report issued by the European Patent Office dated Dec. 17, 2020, which corresponds to European Patent Application No. 20195841.0-1202 and is related to U.S. Appl. No. 16/909,994.

Notice of Allowance mailed by the United States Patent and Trademark Office dated Sep. 12, 2023, which corresponds to U.S. Appl. No. 17/018,521, and is related to the present application.

Communication pursuant to Article 94(3) EPC issued by the European Patent Office dated Sep. 14, 2023, which corresponds to European Patent Application No. 201813706-1009 and is related to the present application.

* cited by examiner

DEVICE, METHOD, AND PROGRAM FOR CONTROLLING SHIP BODY

CROSS-REFERENCE TO RELATED APPLICATION(S)

This application claims priority under 35 U.S.C. § 119 to Japanese Patent Application No. 2019-125657, which was filed on Jul. 5, 2019, the entire disclosure of which is hereby incorporated by reference.

TECHNICAL FIELD

The present disclosure relates to an art which controls an attitude of a ship body.

BACKGROUND

JP2013-151241A discloses a control device for a ship body which orients and holds the ship body in a fixed direction.

However, the conventional control device for the ship body disclosed in JP2013-151241A requires a large-scale configuration.

SUMMARY

Therefore, one purpose of the present disclosure is to provide an art which automatically controls a heading and a thrust of a ship body, without using a large-scale configuration.

According to one aspect of the present disclosure, a ship body control device includes a rudder controller, a sensor, and an autopilot controller. The rudder controller controls a rudder angle of a ship. The sensor measures a ship body direction of the ship. The autopilot controller outputs a rudder angle command to the rudder controller. The autopilot controller includes an angle-of-deviation calculating module and a rudder angle command setting module. The angle-of-deviation calculating module calculates an angle of deviation of a stern direction of the ship from a target stern direction of the ship based on the ship body direction. The rudder angle command setting module sets the rudder angle command so as to maintain a current rudder angle when the angle of deviation is less than a first threshold, and change the rudder angle to a given fixed turning rudder angle when the angle of deviation is the first threshold or more.

With this configuration, the rudder angle and a propulsion force for controlling the ship body can be set by using the angle of deviation and the threshold for the angle of deviation.

According to the present disclosure, the heading and the thrust of the ship body can be automatically controlled, without using the large-scale configuration.

BRIEF DESCRIPTION OF DRAWINGS

The present disclosure is illustrated by way of example and not by way of limitation in the figures of the accompanying drawings, in which like reference numerals indicate like elements and in which.

DETAILED DESCRIPTION

Figure 1A:
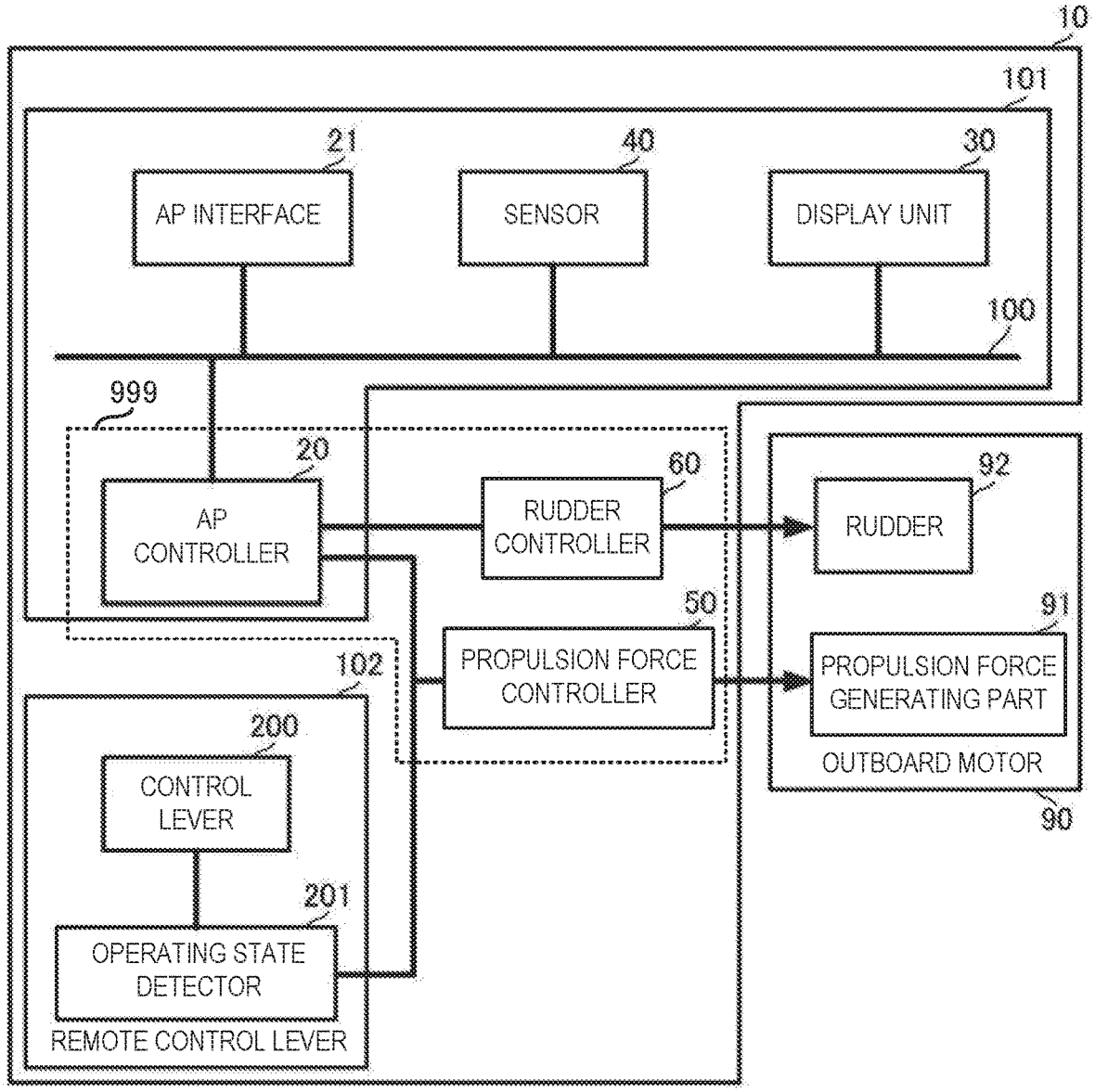
FIG. 1A is a functional block diagram illustrating a configuration of a ship body control device according to one embodiment of the present disclosure.
Figure 1B:
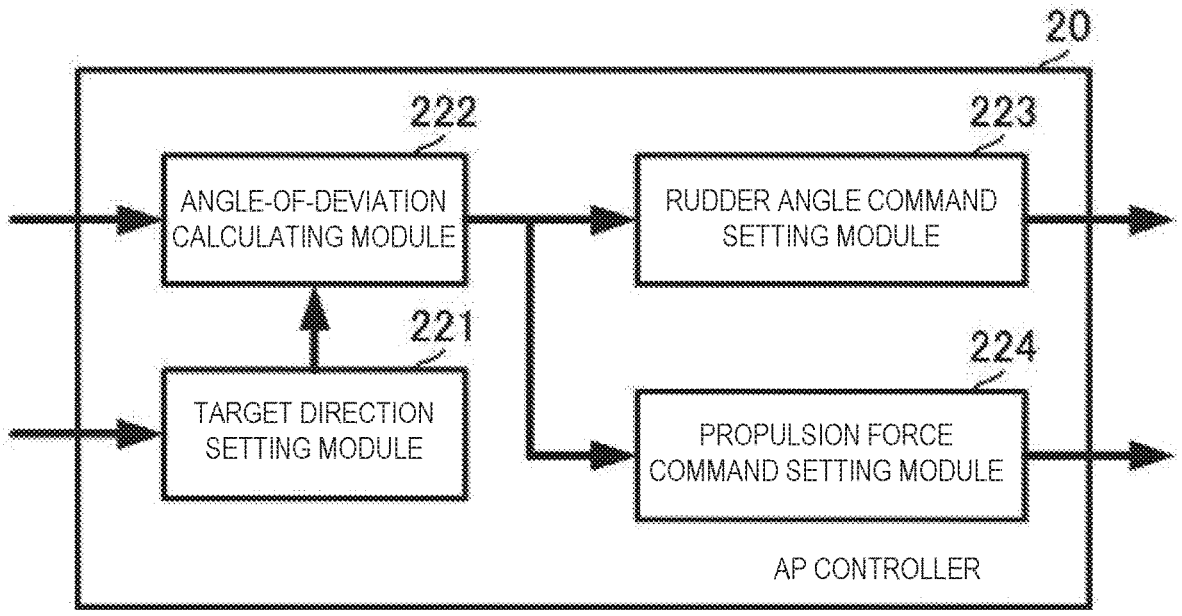
FIG. 1B is a functional block diagram illustrating a configuration of a part of an autopilot controller.

A ship body control device, a ship body control method, and a ship body control program according to one embodiment of the present disclosure will be described with reference to the accompanying drawings. FIG. 1A is a functional block diagram illustrating a configuration of the ship body control device according to this embodiment of the present disclosure. FIG. 1B is a functional block diagram illustrating a configuration of a part of an autopilot controller.

As illustrated in FIG. 1A, a ship body control device 10 may include a main body 101, a remote control lever 102, a propulsion force controller 50, and a rudder controller 60. The main body 101 may include an AP controller 20, an AP interface 21, a display unit 30, and a sensor 40. The remote control lever 102 may include a control lever 200 and an operating state detector 201.

The AP controller 20, the AP interface 21, the display unit 30, and the sensor 40 may be connected with each other through a data communication network 100 for a ship. The AP controller 20, the remote control lever 102, and the propulsion force controller 50 are connected, for example, through a communication network for a propulsion force (e.g., CAN). The AP controller 20 and the rudder controller 60 may be connected through analog voltage or data communications.

A propulsion force generating part 91 may be connected to the propulsion force controller 50. The rudder controller 60 may be connected to a rudder 92. The propulsion force generating part 91 and the rudder 92 are provided to, for example, an outboard motor 90. The propulsion force generating part 91 and the rudder 92 may be provided to, for example, various kinds of propulsion devices, such as an inboard motor and an inboard-outdrive motor.

(Configuration of Main Body 101)

The AP controller 20 is comprised of, for example, a processing unit, such as a CPU, and a memory. The memory may store a program executed by the AP controller 20. Moreover, the memory may be utilized during a calculation by the CPU. The AP controller 20 may correspond to an "autopilot controller" of the present disclosure. The AP controller 20 may output a command related to a control of the ship body to the propulsion force controller 50 and the rudder controller 60. The AP controller 20, the propelling force controller 50 and the rudder controller 60 may also be implemented as "processing circuitry" 999.

Roughly, the AP controller 20 may calculate an angle of deviation from a target direction. The AP controller 20 may set a rudder angle command and a propulsion force command by using the angle of deviation. The AP controller 20 may output the propulsion force command to the propulsion force controller 50. The AP controller 20 may output the rudder angle command to the rudder controller 60.

The AP interface 21 is implemented by, for example, a touch panel, a physical button, and a physical switch. The AP interface 21 may accept an operational input relevant to an autopilot control. The AP interface 21 may output the contents of the operation to the AP controller 20.

The display unit 30 is implemented by, for example, a liquid crystal panel. The display unit 30 may display information relevant to cruising of normal autopilot which is inputted from the AP controller 20. Note that, although the display unit 30 may be omitted, it is desirable to be provided, and with the display unit 30, a user can easily grasp the cruising state.

The sensor 40 may measure measurement data, such as a position and a ship body direction of the ship. Note that the present disclosure may be applied to ships which typically travel on water or sea which are referred to as surface ships, and may also be applied to other types of ships including boats, dinghies, watercrafts, and vessels. The position of the ship may be used for detecting the position of the ship with respect to a position where the ship is to be stopped (fixed-point position) and a route on which the ship is to be moved (cruising route). The ship body direction may be used for calculating the angle of deviation. For example, the sensor 40 is implemented by a positioning sensor, an inertia sensor (e.g., an acceleration sensor, an angular velocity sensor), and a magnetic sensor, utilizing positioning signals of a GNSS (e.g., GPS). Note that at least a stern direction SA may be obtained from the ship body direction. The stern direction SA may be a direction in which the stem is oriented.

Moreover, the sensor 40 may measure disturbances over the ship provided with the ship body control device 10. In detail, the disturbances are, for example, tidal current, a wind direction, and a wind speed. The disturbances are used for, for example, a determination of the target direction. Note that, if setting the target direction only based on the position without using the disturbances, the sensor which measures the disturbances may be omitted.

The sensor 40 may output the measurement data to the AP controller 20.

The propulsion force controller 50 is implemented by, for example, a given electronic circuitry. According to the propulsion force command from the AP controller 20, the propulsion force controller 50 may generate a propulsion force control signal, and output it to the propulsion force generating part 91. The propulsion force generating part 91 is, for example, an engine for the ship. In this case, the propulsion force control signal may be a signal which defines an amount of opening (an opening) of an engine throttle, and a setting of a shift lever (shift F (forward), shift N (neutral), and shift R (reverse)). Note that, during a manual cruise mode, the propulsion force controller 50 may generate the propulsion force control signal according to an operating state from the operating state detector 201 of the remote control lever 102, and output it to the propulsion force generating part 91.

The rudder controller 60 is implemented by, for example, a given electronic circuitry and a physical controlling mechanism for the rudder angle of the rudder 92. The rudder controller 60 may control the rudder angle of the rudder 92 according to the rudder angle command from the AP controller 20.

(Configuration of Remote Control Lever 102)

The control lever 200 may accept an operation from the user during the manual cruise. The operating state detector 201 may be implemented by a sensor etc. The operating state detector 201 may detect an operating state of the control lever 200. The operating state detector 201 may output the detected operating state (angle) of the control lever to the propulsion force controller 50. The AP controller 20 may receive this operating state.

In such a configuration, the AP controller 20 of the ship body control device 10 may execute the following ship body control during an automatic attitude control mode.

As illustrated in FIG. 1B, the AP controller 20 may include a target direction setting module 221, an angle-of-deviation calculating module 222, a rudder angle command setting module 223, and a propulsion force command setting module 224.

The target direction setting module 221 may set a target direction TA. The target direction TA may be set by a direction in which the stern of the ship is oriented. The target direction TA is set, for example, based on arriving directions of disturbances DS, and a spatial relationship between a target position from the AP interface 21 by the user and the position of the ship.

The target direction TA and the stern direction SA may be inputted into the angle-of-deviation calculating module 222. The angle-of-deviation calculating module 222 may calculate a difference between the target direction TA and the stern direction SA as an angle of deviation ψ.

The rudder angle command setting module 223 may set the rudder angle command based on the angle of deviation ψ. Roughly, the rudder angle command setting module 223 may compare the angle of deviation ψ with a (first) threshold THd for a rudder angle control, and set a rudder angle command ηd based on this comparison result. The rudder angle command ηd may be a rudder angle set for the rudder 92.

The propulsion force command setting module 224 may set a propulsion force command based on the angle of deviation ψ. Roughly, the propulsion force command setting module 224 may compare the angle of deviation ψ with a threshold THs for a propulsion force control, and set the propulsion force command based on this comparison result. The propulsion force command is, for example, a throttle opening DG.

Figure 2A:
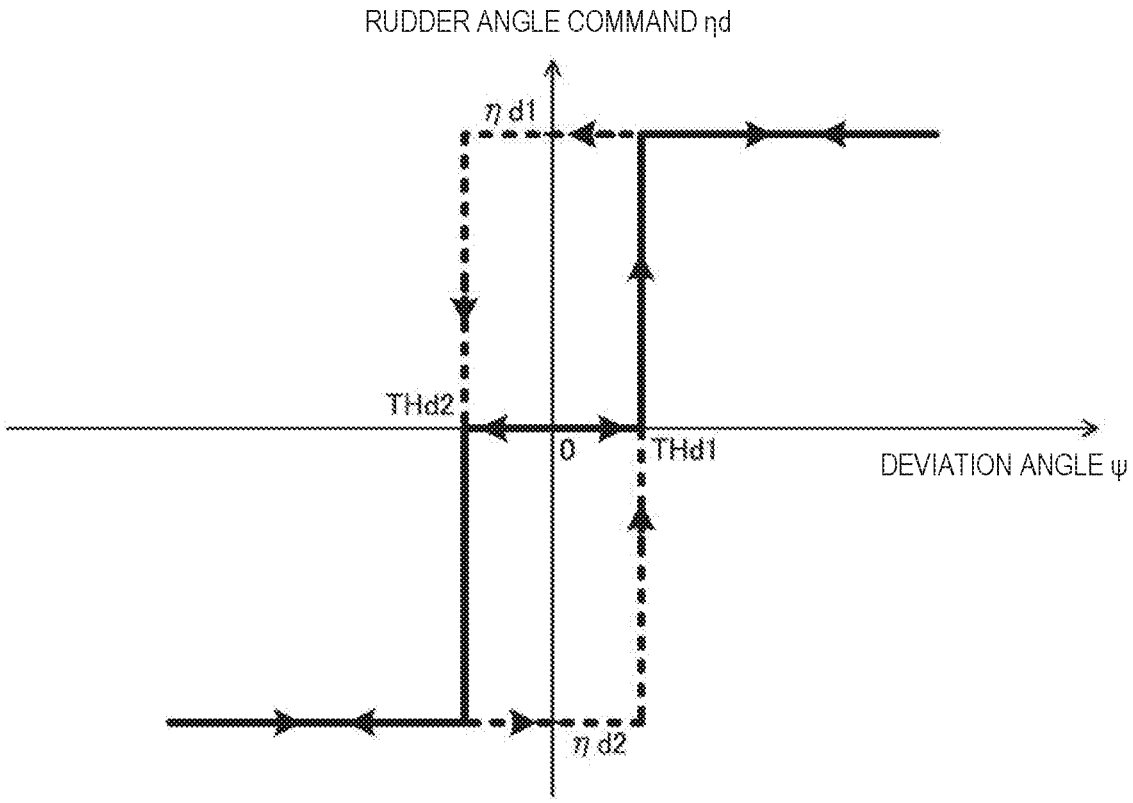
FIG. 2A is a view illustrating a relation between an angle of deviation ψ and a rudder angle command ηd.
Figure 2B:
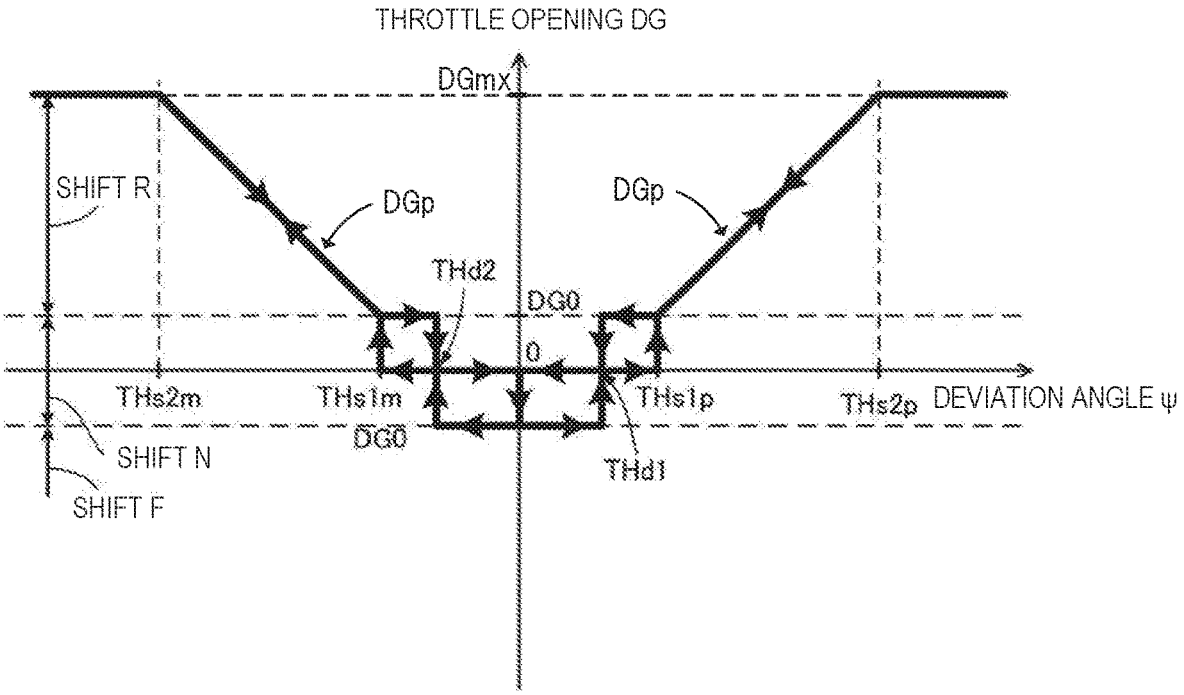
FIG. 2B is a view illustrating a relation between the angle of deviation ψ and a throttle opening DG.

FIG. 2A is a view illustrating a relation between the angle of deviation ψ and the rudder angle command ηd. FIG. 2B is a view illustrating a relation between the angle of deviation ψ and the throttle opening DG. Note that, in FIGS. 2A and 2B, the angle of deviation ψ is set so that it becomes 0° when the target direction TA becomes in agreement with the stern direction SA, the angle of deviation ψ becomes a positive value when the stern inclines to the port side, and the angle of deviation ψ becomes a negative value when the stern inclines to the starboard side.

(Control of Rudder Angle: See FIG. 2A)

During the actual control, the angle of deviation ψ in the initial state may be any value, but, here, the angle of deviation ψ is supposed to be 0° as the initial state for better understandings.

A: When Inclining Toward Port Side First

The rudder angle command setting module 223 may set the rudder angle command ηd0, while the stern inclines to the port side and the angle of deviation ψ is less than a (first) threshold THd1. The rudder angle command ηd0 may be a command for setting the angle of deviation ψ as 0°. That is, the rudder angle command setting module 223 may maintain the current rudder angle.

The threshold THd1 may be defined by an angle of the stern in a state where the stern inclines to the port side at a given angle. The threshold THd1 may be suitably set, for example, according to the size and the shape of the ship, a degree of influence of the rudder angle to the ship body control, and a degree of influence of the disturbances to the ship.

The rudder angle command setting module 223 may set the rudder angle command ηd1 when the angle of deviation ψ becomes the threshold THd1. The rudder angle command ηd1 may be to set the rudder angle of the rudder 92 as a unique turning rudder angle, for example, the maximum rudder angle to the starboard side of the ship body. Note that, in this case, it is not limited to the maximum rudder angle, but it may be a large rudder angle exceeding the given rudder angle at which the ship body direction can be changed largely. This large rudder angle may suitably be set according to the user, characteristics of the ship body, etc. The rudder angle command setting module 223 may set the rudder angle command ηd1, regardless of the angle of deviation ψ, while the angle of deviation ψ is the threshold THd1 or more.

The rudder angle command setting module 223 may maintain the rudder angle command ηd1, while the angle of deviation ψ becomes less than the threshold THd1 from a value of the threshold THd1 or more, and it is more than a (first) threshold THd2 (negative value).

The threshold THd2 may be defined by an angle of the stern in a state where the stern inclines to the starboard side at a given angle. The threshold THd2 may suitably be set, for example, according to the size and the shape of the ship, the degree of influence of the rudder angle to the ship body control, the degree of influence of the disturbances to the ship, etc. The threshold THd2 is, for example, opposite in the sign from the threshold THd1 and the same in the absolute value as the threshold THd1.

The rudder angle command setting module 223 may set the rudder angle command 1*d*2 when the angle of deviation ψ becomes the threshold THd2. The rudder angle command ηd2 may be to set the rudder angle of the rudder 92 as the maximum rudder angle to the port side of the ship body. The rudder angle command setting module 223 may set the rudder angle command ηd2, while the angle of deviation ψ is the threshold THd2 or less, regardless of the angle of deviation ψ.

The rudder angle command setting module 223 may maintain the rudder angle command ηd2, while the angle of deviation ψ becomes more than the threshold THd2 from a value of the threshold THd2 or less, and it is less than the threshold THd1.

Below, the rudder angle command setting module 223 may suitably perform the above-described control according to the angle of deviation ψ and a change in the angle of deviation ψ.

B: When Inclining Toward Starboard Side First

On the other hand, the rudder angle command setting module 223 may perform the following control, when the stern begins to incline from the starboard side.

While the stern begins to incline to the starboard side and the angle of deviation ψ is more than the threshold THd2, the rudder angle command setting module 223 may maintain the current rudder angle, similar to the case where the stern inclines to the port side first.

The rudder angle command setting module 223 may set the rudder angle command 1*d*2 when the angle of deviation ψ becomes the threshold THd2. The rudder angle command ηd2 may be to set the rudder angle of the rudder 92 as a unique turning rudder angle, for example, the maximum rudder angle to the port side of the ship body. Note that, in this case, it is not limited to the maximum rudder angle, but it may be a large rudder angle exceeding the given rudder angle at which the ship body direction can be changed largely. This large rudder angle may suitably be set according to the user, the characteristic of the ship body, etc. The rudder angle command setting module 223 may set the rudder angle command ηd2, while the angle of deviation ψ is the threshold THd2 or less, regardless of the angle of deviation ψ.

The rudder angle command setting module 223 may maintain the rudder angle command ηd2, while the angle of deviation ψ becomes more than the threshold THd2 from a value of the threshold THd2 or less, and it is less than the threshold THd1.

The rudder angle command setting module 223 may set the rudder angle command ηd1 when the angle of deviation ψ becomes the threshold THd1. The rudder angle command ηd1 may be to set the rudder angle of the rudder 92 as the maximum rudder angle to the starboard side of the ship body. The rudder angle command setting module 223 may set the rudder angle command ηd1, while the angle of deviation ψ is the threshold THd1 or more, regardless of the angle of deviation ψ.

The rudder angle command setting module 223 may maintain the rudder angle command ηd1, while the angle of deviation ψ becomes less than the threshold THd1 from a value of the threshold THd1 or more, and it is more than the threshold THd2.

Below, the rudder angle command setting module 223 may suitably perform the above-described control according to the angle of deviation ψ and a change in the angle of deviation ψ.

(Control of Propulsion Force: See FIG. 2B)

A: When Inclining to Port Side

The propulsion force command setting module 224 may maintain the throttle opening DG at 0°, while the stern begins to incline, from a state where the throttle opening DG is 0°, to the port side and the angle of deviation ψ is less than a (second) threshold THs1*p* (positive value). In addition, the propulsion force command setting module 224 may set the clutch to the neutral (shift N).

The threshold THs1*p* may be defined by an angle of the stern in a state where the stern inclines to the port side at a given angle. The threshold THs1*p* may be more than the threshold THd1. The threshold THs1*p* may be determined, in the above-described rudder angle control, by an angle at which steering corresponding to the rudder angle command of the large rudder angle based on the threshold THd1 is finished. Therefore, the propulsion force can be given after the steering is finished, thereby stabilizing the ship body control.

The propulsion force command setting module 224 may set to the throttle opening DG0 when the angle of deviation ψ becomes the threshold THs1*p*. The throttle opening DG0 may correspond to a so-called idling state, where the throttle opening is the minimum opening (a lower limit of the opening) and the clutch is shifted to the reverse (shift R).

The propulsion force command setting module 224 may adjust to a throttle opening DGp according to the angle of deviation ψ, while the angle of deviation ψ is the threshold THs1*p* or more, and less than a (third) threshold THs2*p*. In detail, the propulsion force command setting module 224 may increase the throttle opening DGp in proportion to the absolute value of the angle of deviation ψ.

The propulsion force command setting module 224 may set to a maximum opening DGmx which is a throttle opening at the threshold THs2*p*, while the angle of deviation ψ is more than the threshold THs2*p*. Note that the maximum opening DGmx may be the maximum opening within a range where the safety can be secured during the ship body control.

The propulsion force command setting module 224 may adjust to the throttle opening DGp according to the angle of deviation ψ, while the angle of deviation ψ becomes less than the threshold THs2*p* from a value of the threshold THs2*p* or more, and it is more than the threshold THs1*p*.

The propulsion force command setting module 224 may set the throttle opening DG0, while the angle of deviation ψ is less than the threshold THs1*p* and it is more than the threshold THd1. That is, the propulsion force command setting module 224 may maintain the reverse (shift R) by setting the throttle opening to the minimum opening. The threshold THd1 may be a threshold for the above-described rudder angle command.

The propulsion force command setting module 224 may shift the clutch to the neutral (shift N) and may set the throttle opening DG to 0°, when the angle of deviation ψ becomes the threshold THd1. The propulsion force command setting module 224 may maintain the neutral (shift N) and the throttle opening DG at 0°, while the angle of deviation w is between a value of the threshold THd1 and 0°.

Then, when the ship inclines to the starboard, the propulsion force command setting module 224 may perform the following control in the case of inclining to the starboard.

B: When Inclining to Starboard

The propulsion force command setting module 224 may shift the clutch to the forward (shift F) and set to the throttle opening DG0, while the stern inclines to the starboard side and the angle of deviation ψ is more than a threshold TH2*d* (negative value). The throttle opening DG0 may be the minimum opening (a lower limit of the opening). By performing such a control, the momentum of turning of the ship body can be reduced.

The propulsion force command setting module 224 may shift the clutch to the neutral (shift N) and set the throttle opening DG to 0°, while the angle of deviation ψ is a (second) threshold THs1*m* or more, when the stern further inclines to the starboard side and the angle of deviation ψ becomes the threshold TH2*d* (negative value) or less.

The threshold THs1*m* may be defined by an angle in a state where the stern inclines to the starboard side at a given angle. The threshold THs1*m* may be less than the threshold THd2. The threshold THs1*m* may be determined, in the above-described rudder angle control, by an angle at which the steering corresponding to the rudder angle command of the large rudder angle based on the threshold THd1 is finished, similar to the threshold THs1*p*. Therefore, the propulsion force can be given after the steering is finished, thereby stabilizing the ship body control. The threshold THs1*m* is, for example, opposite in the sign from the threshold THs1*p* and is the same in the absolute value as the threshold THs1*p*.

The propulsion force command setting module 224 may set to the throttle opening DG0, when the angle of deviation ψ becomes the threshold THs1*m*. The throttle opening DG0 may correspond to a so-called idling state, where it is the minimum opening (a lower limit of the opening) and the clutch is shifted to the reverse (shift R).

The propulsion force command setting module 224 may adjust to the throttle opening DGp according to the angle of deviation ψ while the angle of deviation ψ is the threshold THs1*m* or less and a (third) threshold THs2*m* or more. In detail, the propulsion force command setting module 224 may increase the throttle opening DGp in proportion to the absolute value of the angle of deviation ψ.

The propulsion force command setting module 224 may be set to the maximum opening DGmx which is a throttle opening at the threshold THs2*m*, while the angle of deviation ψ is less than the threshold THs2*m*.

The propulsion force command setting module 224 may adjust to the throttle opening DGp according to the angle of deviation ψ, while the angle of deviation ψ becomes more than the threshold THs2*m* from a value of the threshold THs2*m* or less, and it is less than the threshold THs1*m*.

The propulsion force command setting module 224 may set the throttle opening DG0, while the angle of deviation ψ is the threshold THs1*m* or more and is less than the threshold THd2. That is, the propulsion force command setting module 224 may set the throttle opening to the minimum opening and maintains the reverse (shift R). The threshold THd2 may be a threshold for the above-described rudder angle command.

The propulsion force command setting module 224 may shift the clutch to the neutral (shift N), when the angle of deviation ψ becomes the threshold THd2. The propulsion force command setting module 224 may maintain the neutral (shift N), while the angle of deviation ψ is between a value of the threshold THd2 and 0°.

Note that, then, when the ship inclines to the port side, the propulsion force command setting module 224 may shift the clutch to the forward (shift F) and set to the throttle opening DG0, while the angle of deviation ψ is less than the threshold TH1*d* (positive value). The throttle opening DG0 may be the minimum opening (a lower limit of the opening). By performing such a control, the momentum of turning of the ship body can be reduced.

The propulsion force command setting module 224 may perform the above-described control in the case of inclining to the port side.

(Description of State Transition)

Figure 3:
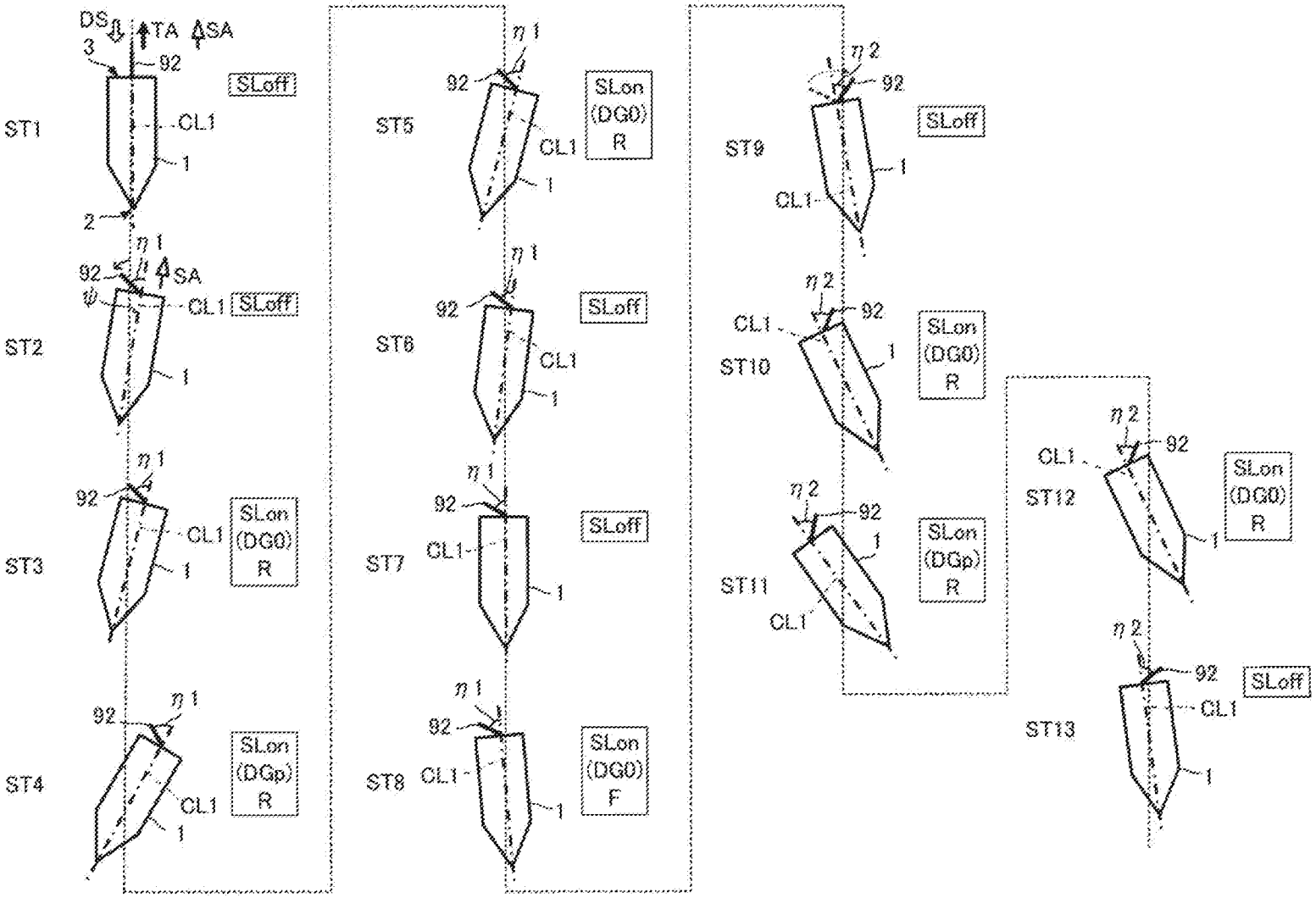
FIG. 3 is a view illustrating a transition of an attitude of a ship.

FIG. 3 is a view illustrating a transition of the attitude of the ship (ship body). ST1-ST13 in FIG. 3 each illustrates a state. In FIG. 3, "1" illustrates the ship body, "2" illustrates the bow, and "3" illustrates the stern. Note that, although the stern direction SA is illustrated in the states ST1 and ST2, illustration is omitted in the states ST3-ST13. The stern direction SA is a direction parallel to a centerline CL1 parallel to the bow-and-stern direction of a ship 1 in FIG. 3 and is a direction in which the stern 3 is oriented.

Below, although a case where the ship inclines to the port side first is described, the AP controller 20 can perform the ship body control similarly, even in a case where the ship inclines to the starboard side.

First, in the state ST1, suppose that the stern direction SA and the target direction TA are the same (the angle of deviation ψ=0°), and the AP controller 20 may set the throttle opening to 0° (throttle-off (SLoff)) and the rudder angle command ηd=0°.

In the state ST2, the ship 1 inclines to the port side. Then, when the angle of deviation ψ reaches the threshold THd1, the AP controller 20 may set the rudder angle command ηd1 with the throttle-off (SLoff). Therefore, the rudder angle may gradually become a rudder angle η1 according to the rudder angle command ηd1.

In the state ST3, the ship 1 further inclines to the port side. Then, when the rudder angle becomes η1 and the angle of deviation ψ reaches the threshold THs1*p*, the AP controller 20 may set the throttle opening DG0. In other words, the AP controller 20 may shift to the reverse, and set the throttle opening to the minimum opening from 0°. Here, the AP controller 20 may maintain the rudder angle command ηd1.

Thus, by this control, it may become possible to reduce a rate of the ship 1 inclining to the port side.

In the state ST4, the ship 1 further inclines to the port side. Then, the AP controller 20 may set the throttle opening DGp according to the absolute value of the angle of deviation ψ. Here, the AP controller 20 may maintain the rudder angle command ηd1. By this control, the state of the ship 1 inclining to the port side may be stopped, and the stern direction SA may approach the target direction TA.

In the state ST5, when the stern direction SA approaches the target direction TA and the angle of deviation ψ reaches the threshold THs1*p*, the AP controller 20 may set the throttle opening DG0. In other words, the AP controller 20 may set the throttle opening to the minimum opening and maintain the reverse state. Here, the AP controller 20 may maintain the rudder angle command ηd1. Therefore, a rate the stern direction SA approaching the target direction TA can be reduced.

In the state ST6, when the stern direction SA further approaches the target direction TA and the angle of deviation ψ reaches the threshold THd1, the AP controller 20 may control into the throttle-off (SLoff) state. Here, the AP controller 20 may maintain the rudder angle command ηd1. Thus, the rate of the stern direction SA approaching the target direction TA can be reduced, and it can be prevented that the stern direction SA exceeds the target direction TA and the ship 1 inclines to the starboard side.

In the state ST7, the stern direction SA is in agreement with the target direction TA. In this state, the AP controller 20 may maintain the throttle-off (SLoff) state and maintain the rudder angle command ηd1.

In the state ST8, the ship 1 inclines to the starboard side. The AP controller 20 may shift to the forward (shift F) and set to the throttle opening DG0, while the angle of deviation ψ is more than the threshold THd2. Therefore, the momentum of turning of the ship 1 can be reduced.

In the state ST9, the ship 1 further inclines to the starboard side. Then, when the angle of deviation ψ reaches the threshold THd2, the AP controller 20 may set the throttle-off (SLoff) and set so as to switch the rudder angle command ηd1 to the rudder angle command ηd2. Therefore, the rudder angle gradually may become the rudder angle η2 according to the rudder angle command ηd2.

In the state ST10, the ship 1 further inclines to the starboard side. Then, when the rudder angle becomes η2 and the angle of deviation ψ becomes the threshold THs1*m*, the AP controller 20 may set the throttle opening DG0. In other words, the AP controller 20 may shift to the reverse (shift R) and set the throttle opening to the minimum opening from 0°. Here, the AP controller 20 may maintain the rudder angle command ηd2. Thus, by this control, it may become possible to reduce the rate of the ship 1 inclining to the starboard side.

In the state ST11, the ship 1 may further incline to the starboard side. Then, the AP controller 20 may set the throttle opening DGp according to the absolute value of the angle of deviation ψ. Here, the AP controller 20 may maintain the rudder angle command 1*d*2. By this control, the state of the ship 1 inclining to the starboard side may be stopped, and the stern direction SA may approach the target direction TA.

In the state ST12, when the stern direction SA approaches the target direction TA and the angle of deviation ψ becomes the threshold THs1*m*, the AP controller 20 may set the throttle opening DG0. In other words, the AP controller 20 may set the throttle opening to the minimum opening and maintain the reverse state. Here, the AP controller 20 may maintain the rudder angle command ηd2. Therefore, the rate of the stem direction SA approaching the target direction TA can be reduced.

In the state ST13, when the stern direction SA further approaches the target direction TA and the angle of deviation ψ reaches the threshold THd2, the AP controller 20 may control into the throttle-off (SLoff) state. Here, the AP controller 20 may maintain the rudder angle command ηd2. Therefore, the rate of the stem direction SA approaching the target direction TA can be reduced and it can be prevented that the stern direction SA exceeds the target direction TA and the ship 1 inclines to the port side.

Thereafter, when the ship again inclines to the port side, similar to the above-described state ST8, by shifting to the forward, controlling the throttle opening DG0 (minimum opening), and further performing the control according to each of the above-described states, the AP controller 20 can sequentially control so that the stem direction SA becomes in agreement with the target direction TA. Therefore, by using such a configuration and control, even if the ship body control device 10 has the simple configuration of one rudder and one propulsion force, it can stably perform the ship body control in which the stern direction SA is made in agreement with the target direction TA.

(Description of Method and Program for Controlling Ship Body)

In the above description, the controls of the rudder angle and the propulsion force may be performed by the individual functional parts, respectively. However, if the AP controller 20 is implemented by a ship body control program stored in the processing unit, such as the CPU, and the memory, or when it is implemented by a programmable IC (included in a kind of the processing unit of the present disclosure), a method illustrated in the following flowchart may be applied as the method and program for controlling the ship body. Note that the following rudder angle command and propulsion force command may be those described above, and therefore, detailed description thereof is omitted.

(Method of Controlling Rudder Angle)

Figure 4:
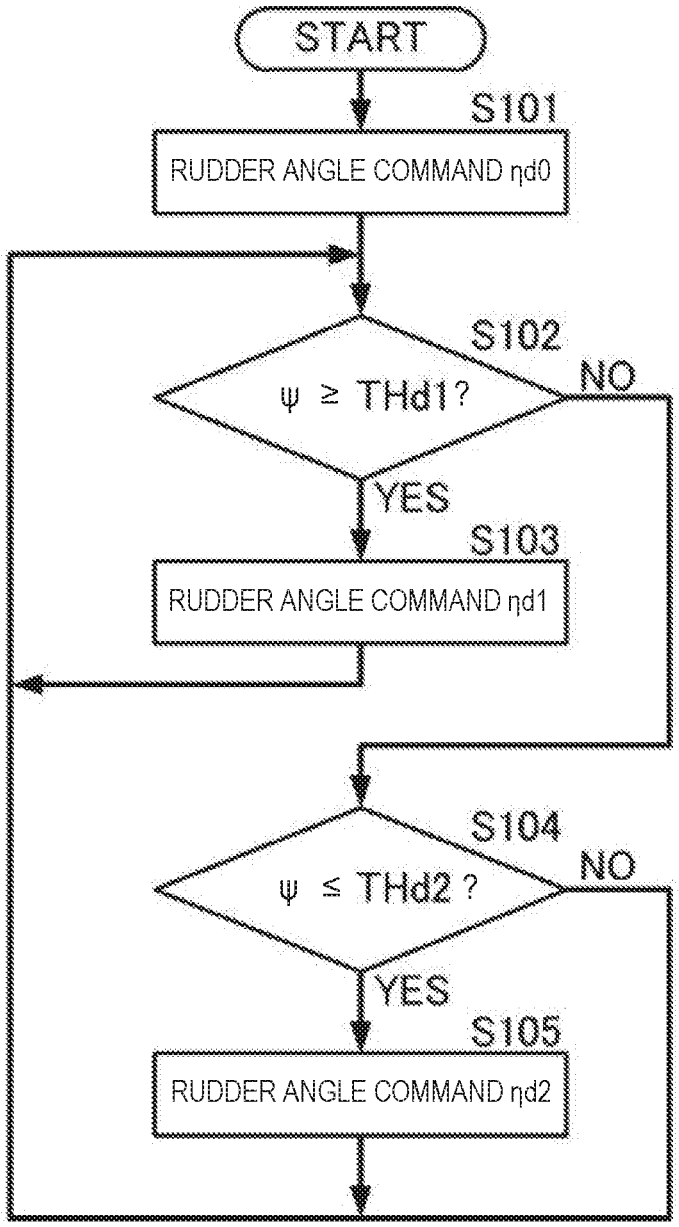
FIG. 4 is a flowchart illustrating a method of controlling a rudder angle.

FIG. 4 is a flowchart illustrating the method of controlling the rudder angle.

The AP controller 20 may set the rudder angle command ηd0 (=0°) (Step S101). If the angle of deviation ψ is the threshold THd1 or more (Step S102: YES), the AP controller 20 may set the rudder angle command ηd1 (Step S103).

If the angle of deviation ψ is less than the threshold THd1 (Step S102: NO), and if it is the threshold THd2 or less (Step S104: YES), the AP controller 20 may set the rudder angle command ηd2 (Step S105).

If the angle of deviation ψ is less than the threshold THd1 (Step S102: NO) and if it is more than the threshold THd2 (Step S104: NO), the AP controller 20 may maintain the current rudder angle command.

(Method of Controlling Propulsion Force)

Figure 5:
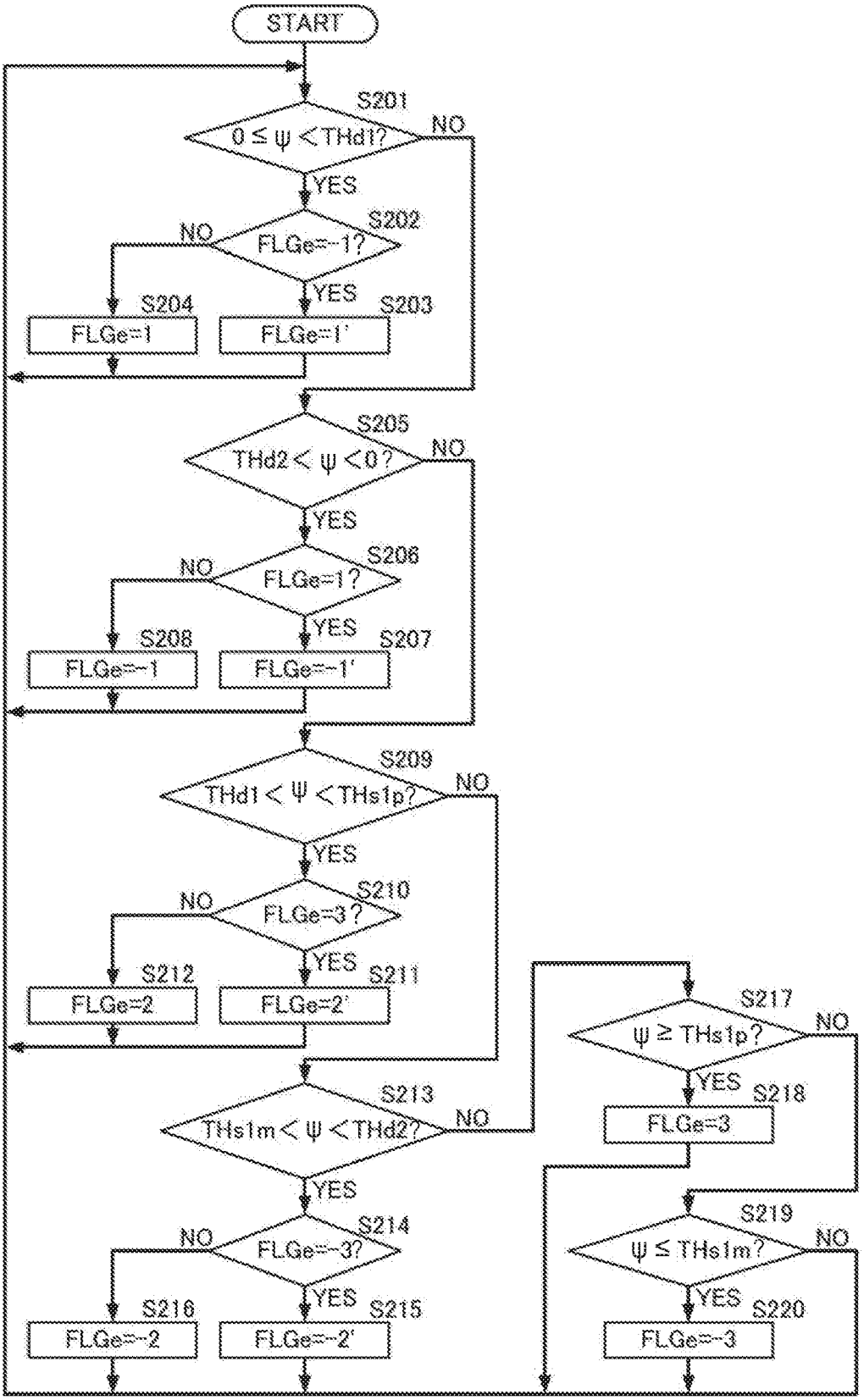
FIG. 5 is a flowchart illustrating a method of controlling a propulsion force.

FIG. 5 is a flowchart illustrating the method of controlling the propulsion force. In FIG. 5, FLGe=1 and FLGe=−1 are controls for shifting to the neutral (shift N) and setting the throttle opening to 0°. FLGe=1' and FLGe=−1' are controls for shifting to the forward (shift F) and setting the throttle opening to DG0 (idling control). FLGe=2 and FLGe=−2 are controls for shifting to the neutral (shift N) and setting the throttle opening to 0°. FLGe=2' and FLGe=−2' are controls for shifting to the reverse (shift R) and setting the throttle opening to DG0 (idling control). FLGe=3 and FLGe=−3 are controls for shifting to the reverse (shift R), and setting the throttle opening to DGp (i.e., a control of the opening by multiplying the absolute value of the angle of deviation ψ by a constant and adding the minimum opening to the resultant).

If the angle of deviation ψ is 0° or more and less than the threshold THd1 (Step S201: YES), the AP controller 20 may transit to Step S202, and if the angle of deviation ψ is not 0° or more and not less than the threshold THd1 (Step S201: NO), the AP controller 20 may transit to Step S205.

At Step S202, if FLGe=−1 (Step S202: YES), the AP controller 20 may perform a control of FLGe=1' (Step S203), and if it is not FLGe=−1 (Step S202: NO), the AP controller 20 may perform a control of FLGe=1 (Step S204) and return to Step S201.

At Step S205, if the angle of deviation ψ is less than 0° and is more than the threshold THd2 (Step S205: YES), the AP controller 20 may shift to Step S206, and if the angle of deviation ψ is not less than 0° and not more than the threshold THd2 (Step S205: NO), the AP controller 20 may transit to Step S209.

At Step S206, if FLGe=1 (Step S206: YES), the AP controller 20 may perform a control of FLGe=−1' (Step S207), and if not FLGe=−1 (Step S206: NO), the AP controller 20 may perform a control of FLGe=1 (Step S208) and return to Step S201.

At Step S209, if the angle of deviation ψ is more than the threshold THd1 and it is less than the threshold THs1*p* (Step S209: YES), the AP controller 20 may transit to Step S210, and if the angle of deviation ψ is not more than the threshold THd1 and not less than the threshold THs1*p* (Step S209: NO), the AP controller 20 may transit to Step S213.

At Step S210, if FLGe=3 (Step S210: YES), the AP controller 20 may perform a control of FLGe=2' (Step S211), and if not FLGe=3 (Step S210: NO), the AP controller 20 may perform a control of FLGe=2 (Step S212) and return to Step S201.

At Step S213, if the angle of deviation ψ is more than the threshold THs1*m* and it is less than the threshold TH2*d* (Step S213: YES), the AP controller 20 may transit to Step S214, and if the angle of deviation ψ is not more than the threshold THs1*m* and not less than the threshold TH2*d* (Step S213: NO), the AP controller 20 may transit to Step S217.

At Step S214, if FLGe=−3 (Step S214: YES), the AP controller 20 may perform a control of FLGe=−2' (Step S215), and if not FLGe=−3 (Step S214: NO), the AP controller 20 may perform a control of FLGe=−2 (Step S216) and return to Step S201.

At Step S217, if the angle of deviation ψ is the threshold THs1*p* or more (Step S217: YES), the AP controller 20 may perform a control of FLGe=3 (Step S218) and return to Step S201.

At Step S217, if the angle of deviation ψ is not the threshold THs1*p* or more (Step S217: NO), the AP controller 20 may transit to Step S219.

At Step S219, if the angle of deviation ψ is the threshold THs1*p* or less (Step S219: YES), the AP controller 20 may perform a control of FLGe=−3 (Step S220) and return to Step S201. At Step S219, if the angle of deviation ψ is not the threshold THs1*p* or less (Step S219: NO), the AP controller 20 may return to Step S201.

Note that the above-described control for shifting to the forward when the angle of deviation ψ is small may be omitted. However, since the momentum of turning of the ship body of the ship can be reduced by performing this control as described above, it may be desirable to perform this control.

Terminology

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

All of the processes described herein may be embodied in, and fully automated via, software code modules executed by a computing system that includes one or more computers or processors. The code modules may be stored in any type of non-transitory computer-readable medium or other computer storage device. Some or all the methods may be embodied in specialized computer hardware.

Many other variations than those described herein will be apparent from this disclosure. For example, depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks and modules described in connection with the embodiments disclosed herein can be implemented or performed by a machine, such as a processor. A processor can be a microprocessor, but in the alternative, the processor can be a controller, microcontroller, or state machine, combinations of the same, or the like. A processor can include electrical circuitry configured to process computer-executable instructions. In another embodiment, a processor includes an application specific integrated circuit (ASIC), a field programmable gate array (FPGA) or other programmable device that performs logic operations without processing computer-executable instructions. A processor can also be implemented as a combination of computing devices, e.g., a combination of a digital signal processor (DSP) and a microprocessor, a plurality of microprocessors, one or more microprocessors in conjunction with a DSP core, or any other such configuration. Although described herein primarily with respect to digital technology, a processor may also include primarily analog components. For example, some or all of the signal processing algorithms described herein may be implemented in analog circuitry or mixed analog and digital circuitry. A computing environment can include any type of computer system, including, but not limited to, a computer system based on a microprocessor, a mainframe computer, a digital signal processor, a portable computing device, a device controller, or a computational engine within an appliance, to name a few.

Conditional language such as, among others, "can," "could," "might" or "may," unless specifically stated otherwise, are otherwise understood within the context as used in general to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Any process descriptions, elements or blocks in the flow diagrams described herein and/or depicted in the attached figures should be understood as potentially representing modules, segments, or portions of code which include one or more executable instructions for implementing specific logical functions or elements in the process. Alternate implementations are included within the scope of the embodiments described herein in which elements or functions may be deleted, executed out of order from that shown, or discussed, including substantially concurrently or in reverse order, depending on the functionality involved as would be understood by those skilled in the art.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C. The same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations).

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.).

For expository purposes, the term "horizontal" as used herein is defined as a plane parallel to the plane or surface of the floor of the area in which the system being described is used or the method being described is performed, regardless of its orientation. The term "floor" can be interchanged with the term "ground" or "water surface". The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than 10% of the stated amount. Features of embodiments disclosed herein preceded by a term such as "approximately", "about", and "substantially" as used herein represent the feature with some variability that still performs a desired function or achieves a desired result for that feature.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. A ship body control device, comprising:

a sensor configured to measure a ship body direction of the ship; and processing circuitry configured:

to calculate an angle of deviation of a stern direction of the ship from a target stern direction of the ship based on the ship body direction;

to set a rudder angle command so as to maintain a current rudder angle when the angle of deviation is less than a first threshold, and change the rudder angle to a given fixed turning rudder angle when the angle of deviation is the first threshold or more;

to control a propulsion force of the ship;

to set a propulsion force command so that:

the propulsion force is zero when the angle of deviation is less than a second threshold, and the propulsion force is a value according to the angle of deviation when the angle of deviation is the second threshold or more.

2. The ship body control device of claim 1, wherein when the angle of deviation is equal to or more than a third threshold being more than the second threshold, the processing circuitry sets the propulsion force command so as to maintain the propulsion force at the third threshold.

3. The ship body control device of claim 2, wherein the processing circuitry is further configured:

to set the propulsion force command so as to control a propulsion force of the ship;

to shift a clutch to a reverse position when the angle of deviation decreases and is between the second threshold and the first threshold, and to shift the clutch to a neutral position when the angle of deviation decreases and is less than the first threshold.

4. The ship body control device of claim 2, wherein when the angle of deviation is between zero and the first threshold, the processing circuitry sets the propulsion force command so as:

to shift a clutch to a forward position, and to control the propulsion force to be a minimum state.

5. The ship body control device of claim 2, wherein the second threshold is more than the first threshold.

6. The ship body control device of claim 2, wherein the turning rudder angle is a maximum rudder angle to be set as the rudder angle.

7. The ship body control device of claim 1, wherein the processing circuitry is further configured:

to set the propulsion force command so as to control a propulsion force of the ship;

to shift a clutch to a reverse position when the angle of deviation decreases and is between the second threshold and the first threshold, and to shift the clutch to a neutral position when the angle of deviation decreases and is less than the first threshold.

8. The ship body control device of claim 7, wherein when the angle of deviation is between zero and the first threshold, the processing circuitry sets the propulsion force command so as:

to shift a clutch to a forward position, and to control the propulsion force to be a minimum state.

9. The ship body control device of claim 7, wherein the second threshold is more than the first threshold.

10. The ship body control device of claim 7, wherein the turning rudder angle is a maximum rudder angle to be set as the rudder angle.

11. The ship body control device of claim 1, wherein when the angle of deviation is between zero and the first threshold, the processing circuitry sets the propulsion force command so as:

to shift a clutch to a forward position, and to control the propulsion force to be a minimum state.

12. The ship body control device of claim 1, wherein the second threshold is more than the first threshold.

13. The ship body control device of claim 1, wherein the turning rudder angle is a maximum rudder angle to be set as the rudder angle.

14. A method of controlling a ship body, comprising:

measuring a ship body direction of a ship;

calculating an angle of deviation of a stern direction of the ship from a target stern direction of the ship based on the ship body direction;

setting a rudder angle command so as to maintain a current rudder angle when the angle of deviation is less than a first threshold, and change the rudder angle to a given fixed turning rudder angle when the angle of deviation is the first threshold or more; and controlling the rudder angle of the ship based on the rudder angle command, wherein a propulsion force command is set so that a propulsion force is zero when the angle of deviation is less than a second threshold, and the propulsion force is a value according to the angle of deviation when the angle of deviation is the second threshold or more, and the propulsion force of the ship is controlled based on the propulsion force command.

15. The method of claim 14, wherein a clutch for the propulsion force is shifted to a forward position, and the propulsion force is controlled to be a minimum state when the angle of deviation is between zero and the first threshold.

16. A non-transitory computer-readable recording medium storing a program causing processing circuitry of a ship body control device to execute processing, the processing circuitry configured to control operation of the device, the processing comprising:

measuring a ship body direction of a ship;

calculating an angle of deviation of a stern direction of the ship from a target stern direction of the ship based on the ship body direction;

setting a rudder angle command so as to maintain a current rudder angle when the angle of deviation is less than a first threshold, and change the rudder angle to a given fixed turning rudder angle when the angle of deviation is the first threshold or more;

controlling the rudder angle of the ship based on the rudder angle command, wherein a propulsion force command is set so that a propulsion force is zero when the angle of deviation is less than a second threshold, and the propulsion force is a value according to the angle of deviation when the angle of deviation is the second threshold or more, and the propulsion force of the ship is controlled based on the propulsion force command.

17. The recording medium of claim 16, wherein a clutch for the propulsion force is shifted to a forward position, and the propulsion force is controlled to be a minimum state when the angle of deviation is between zero and the first threshold.

* * * * *